United States Patent [19]

Barker et al.

[11] Patent Number: 4,461,273

[45] Date of Patent: Jul. 24, 1984

[54] STOVE

[75] Inventors: Anthony M. Barker, Geraldine; Robert N. Lockhart, Auckland, both of New Zealand

[73] Assignee: Kent Heating Limited, Mangere, New Zealand

[21] Appl. No.: 271,853

[22] Filed: Jun. 9, 1981

[51] Int. Cl.[3] ..... F24C 1/14; F23M 7/00

[52] U.S. Cl. ..... 126/77; 126/83; 126/197; 126/289

[58] Field of Search ..... 126/76, 77, 83, 190, 126/193, 198, 197, 200, 192, 287, 289, 290

[56] References Cited

U.S. PATENT DOCUMENTS

| | | | |
|---|---|---|---|
| 1,430,013 | 9/1922 | Hopkins et al. . | |
| 1,527,153 | 2/1925 | Gray | 126/287 |
| 2,448,891 | 9/1948 | Katz | 126/290 |
| 2,864,358 | 12/1958 | Harding | 126/77 |
| 3,162,188 | 12/1964 | Tompers | 126/140 |
| 3,616,788 | 11/1971 | Hannebaum | 126/135 |
| 4,154,211 | 5/1979 | Choate | 126/193 |
| 4,154,212 | 5/1979 | Wilkinson | 126/198 |
| 4,192,285 | 3/1980 | Nietupski | 126/83 |
| 4,196,713 | 4/1980 | Blankenship | 126/77 |
| 4,207,861 | 6/1980 | Buckner | 126/193 |
| 4,230,093 | 10/1980 | Buckner | 126/197 |
| 4,300,526 | 11/1981 | McKay | 126/77 |
| 4,320,742 | 3/1982 | Piontkowski | 126/289 |
| 4,329,930 | 5/1982 | Riley | 126/193 |
| 4,355,624 | 10/1982 | Hardin et al. | 126/77 |
| 4,368,721 | 1/1983 | Kroupa | 126/289 |
| 4,368,722 | 1/1983 | Lynch | 126/83 |

FOREIGN PATENT DOCUMENTS

| | | |
|---|---|---|
| 578796 | 7/1946 | United Kingdom . |
| 667570 | 3/1952 | United Kingdom . |

*Primary Examiner*—Daniel J. O'Connor

*Attorney, Agent, or Firm*—Holman & Stern

[57] ABSTRACT

A slow combustion stove having a transparent portion to enable vision into a primary combustion zone so that flames are visible in use has a double burning combustion chamber defined by the primary combustion chamber and a partitioned off secondary burning combustion chamber, an air inlet to enable air to circulate within the stove adjacent a deflector which deflects the incoming air over the transparent portion to cool and resist staining and soot build-up thereon. A majority of the air passes to the primary combustion zone and a proportion of further gases enter the secondary combustion chamber with the gases of primary combustion for combustion of smoke and other unburned gases. A by-pass is provided for by-passing the normal combustion flow path when lighting the stove and additionally, an interlock is provided for preventing accidental opening of a door into the stove while the by-pass is closed, said by-pass damper is jamming resistant and acts as a pressure relief valve by virtue of the provision of a damper head to float and rotate relative to its mounting and support.

6 Claims, 5 Drawing Figures

FIG. 1.
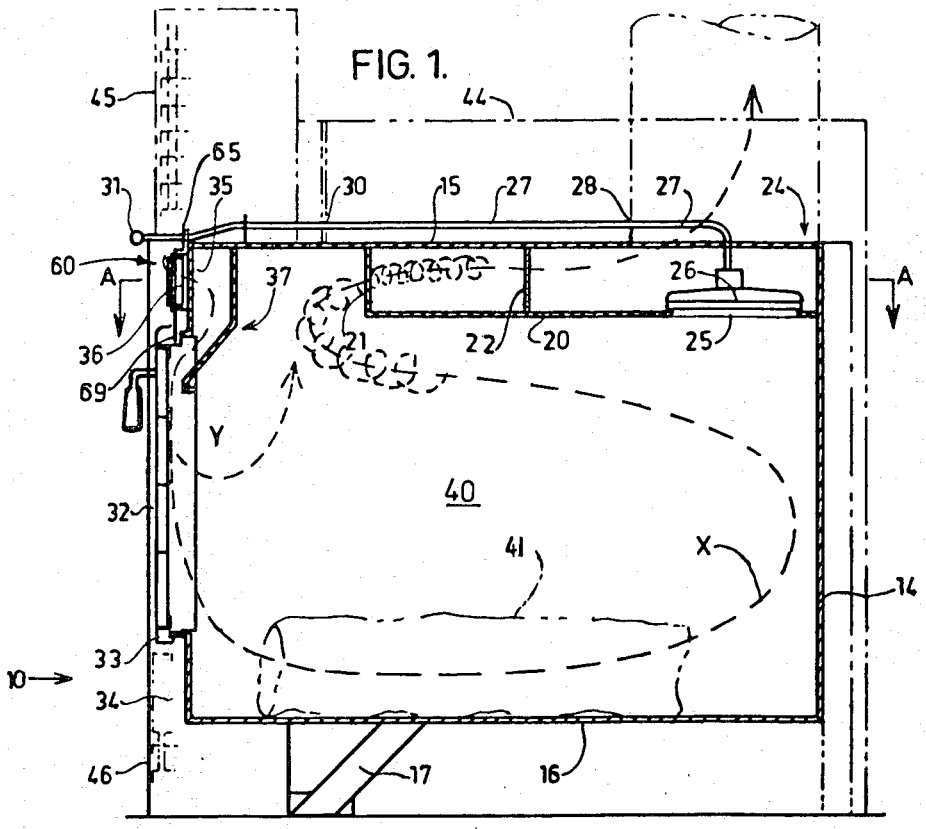
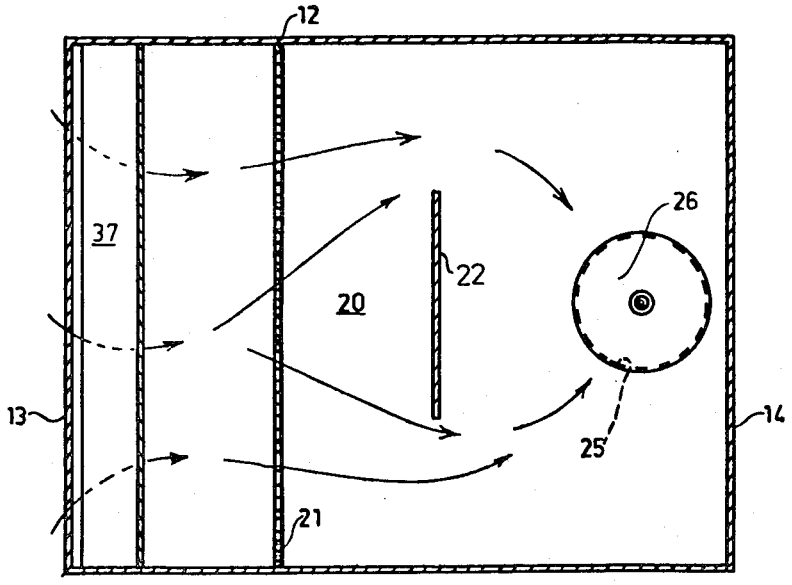
FIG. 2.

STOVE

BACKGROUND OF THE INVENTION

1. Field of the Invention

This invention relates to stoves and has particular (though not sole) application to slow combustion stoves.

2. Description of the Prior Art

Slow combustion stoves usually consist of a substantially airtight container with a restricted air inlet, a combustion zone and an outlet, so that by controlling the amount of air admitted to the combustion zone, the rate of combustion and the efficiency of combustion can be controlled.

Existing slow combustion stoves have not proved to be entirely satisfactory, as the very slowness of combustion may not allow for complete combustion.

There is a need to provide a slow combustion stove which allows for controlled and efficient combustion of wood and other material.

It is an object of this invention to meet this need by providing an improved slow combustion stove which will allow for controlled and efficient combustion.

In one aspect, the invention provides a stove including: a casing surrounding a combustion zone; a door in one wall of the casing, an air inlet in an upper region of the casing; a deflector in conjuction with said air inlet to deflect air downwardly within said casing past a transparent portion in a front face of said casing and to an outlet from said casing.

BRIEF DESCRIPTION OF THE DRAWINGS

Other aspects of this invention which should be considered in all its novel aspects, will become apparent from the following description, which is given by way of example only, with reference to the accompanying drawings, in which:

FIG. 1 is a vertical a cross-sectional view of a preferred stove in accordance with the invention FIG. 2 is a plan view taken along line A—A of FIG. 1 with the top removed to show the baffle arrangement;

DESCRIPTION OF THE PREFERRED EMBODIMENTS

Figure 3:
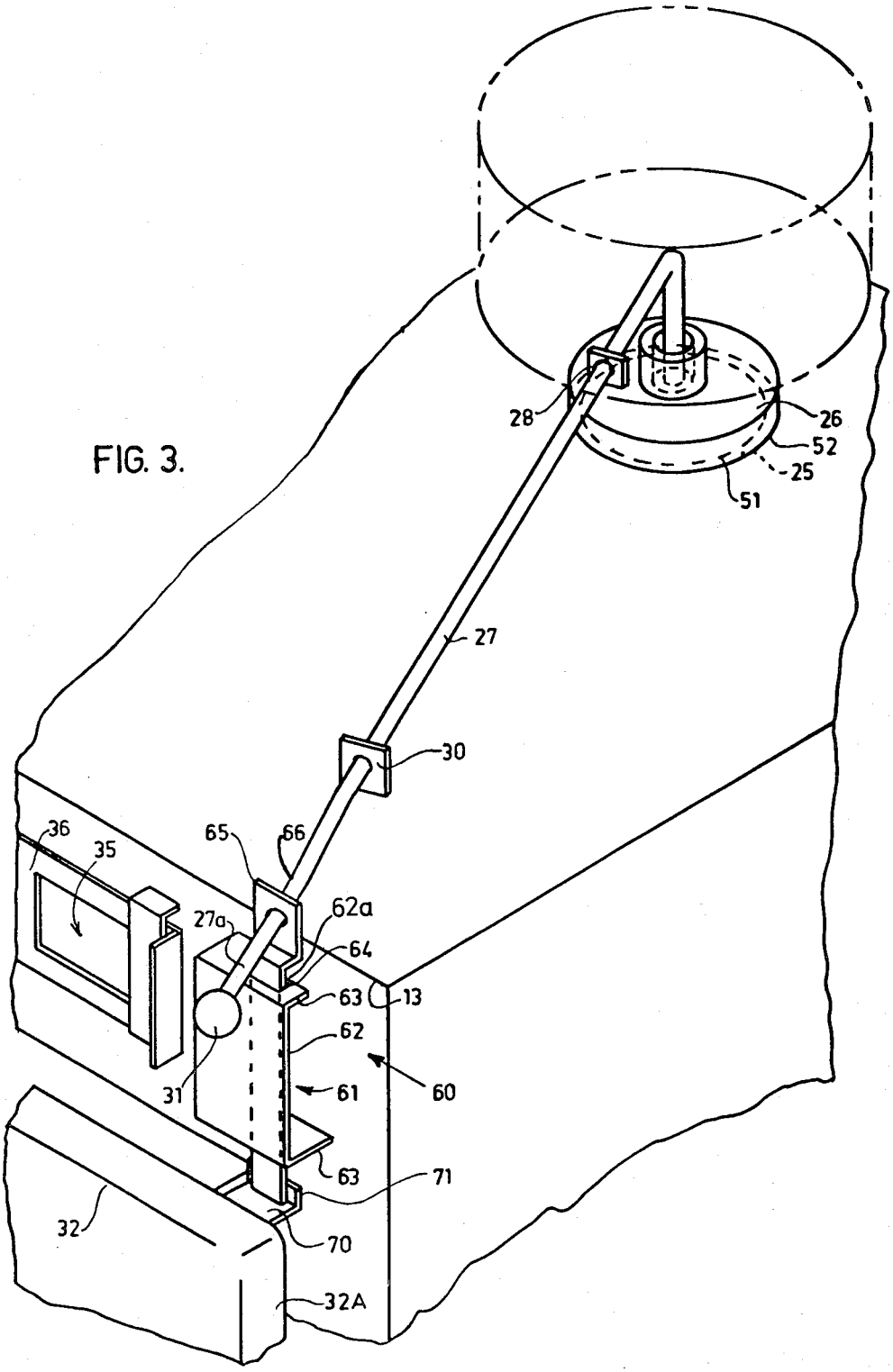
FIG. 3 is a partial diagrammatic perspective view showing the by-pass damper and interlock mechanism in accordance with the invention

A slow combustion stove has a casing 10 with side walls 12 a front wall 13 incorporating an openable door 32, a rear wall 14, a roof 15, and a base 16. In this embodiment the housing is formed of metal and is provided with legs 17.

Within the casing 10, a substantially horizontally partition 20 is provided. Conveniently, the partition 20 is attached to the rear wall 14 and to almost the full length of the side walls 12 to provide a ceiling within the casing leaving an aperture for the escape of combustion gases around the end of the partition 20. In addition, a series of substantially upright baffles 21 and 22 are provided between the partition 20 and the roof 15. Conveniently, these baffles 21 and 22 are spaced as shown in FIG. 1, and the upstream baffle 21 is apertured so that the flow path of combustion gases along the interface between partition 20 and the roof 15 is substantially increased and is made substantially turbulent for efficient mixing of gases of combustion with unburnt gases.

An outlet 24 is provided in the casing 10 and this is conveniently in the form of an outlet flue. As shown in FIG. 1, the partition 20 extends from the rear wall 14 towards the front wall 13 of the casing 10.

Figure 4:
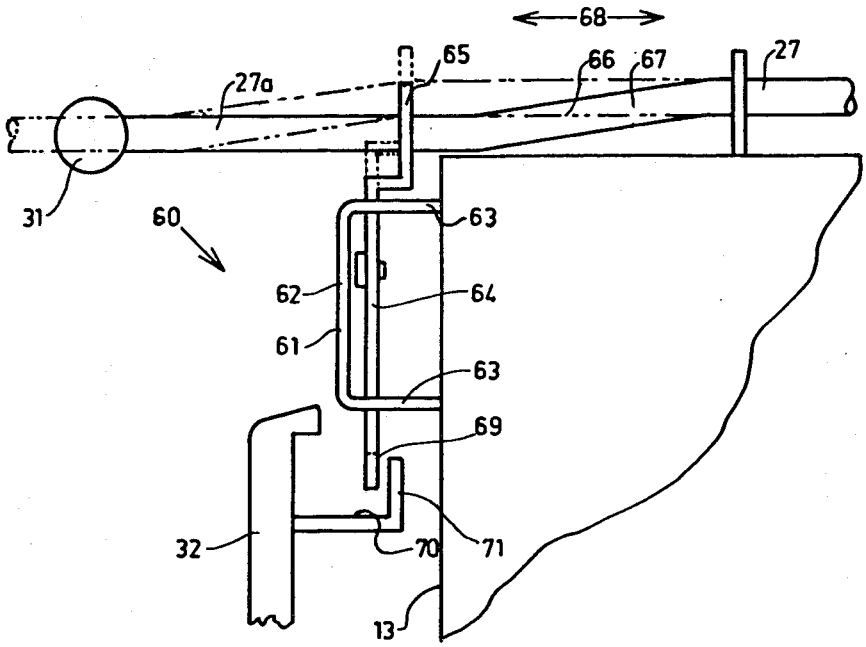
FIG. 4 is a partial diagrammatic side view of the interlock arrangement showing the interlock in an engaged position in solid lines and in a disengaged position in dotted lines.

To assist in starting of the slow combustion stove, a by-pass aperture 25 is provided in the partition 20 adjacent the outlet 24. The by-pass aperture 25 is closeable by a by-pass damper 26 which is slidable to position over the by-pass aperture 25 to control a direct draft from a primary combustion zone 40 via the by-pass aperture 25 to the outlet 24. Conveniently, control of the by-pass damper 26 is achieved by a control rod 27 slidably mounted with respect to the casing 10. As shown in FIGS. 1, 3 and 4, this control rod 27 has a substantially upright portion connected to the by-pass damper 26 and a substantially horizontal portion passing through an aperture 28 in the outlet flue and supported by an apertured support 30 towards the front end of the casing 10. A handle 31 is provided on an outer end of the rod 27.

Figure 5:
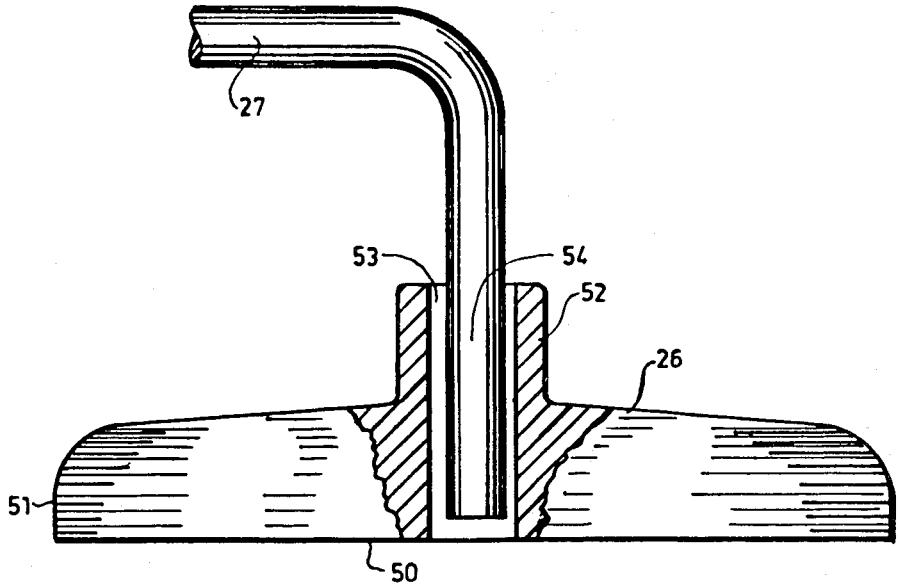
FIG. 5 is a diagrammatic cross-sectional view of the damper/control rod assembly.

With specific reference to FIGS. 3 and 5, the by-pass damper 26 is preferably provided in a substantially heavy material for example cast iron and the like and is preferably provided as a substantially annular disc-like member having a substantially planar lower face 50 and a substantially circular periphery 51 however, in alternative forms of the invention, it is to be appreciated that the annular nature of the by-pass damper 26 is in no way essential.

The by-pass damper 26 is provided in this form of the invention with a substantially recessed upstanding part 52 substantially medially thereon, said upstand 52 incorporating an opening 53 therein, within which an end 54 of the upright portion of the control rod 27 engages. It is to be appreciated that the engagement of the end 54 of the control rod 27 with the by-pass damper 26 is in a substantially loose fit arrangement so as to allow a degree of float to occur between the end 54 and the by-pass damper 26 and further, to allow the by-pass damper 26 to be free to rotate relative to the end 54.

In view of the substantially heavy construction of the by-pass damper 26 it will be appreciated that the by-pass damper 26 is biased by gravity against the upper surface of the partition 20 upon which it slides and into a close association with said by-pass opening 25 when positioned thereover.

In alternative forms of the invention, it is envisaged that some biasing means could alternatively be provided for biasing the by-pass damper 26 downwardly over the by-pass aperture 25 such as for example spring means and the like. Owing to the substantially floating nature of the by-pass damper 26 relative to the control rod 27 it will be appreciated that expansion and contraction of adjacent parts of the structure in use can be accommodated by the by-pass to thus avoid the possibility of the by-pass damper 26 jamming or sticking in an undesired position, such as in the open position which could result in fierce primary combustion operation and therefore danger.

The biased, by-pass damper 26 further provides a substantially safety or pressure relief valve action to the stove whereby in the event that a sudden increase in pressure is encountered within the primary combustion zone 40, the pressure can overcome the downward bias of the by-pass damper 26 when closed over the by-pass aperture 25 to thus rapidly release the pressure from within the casing 10.

The casing 10 is provided with a transparent portion in the front face 13 thereof. Preferably the door 32 has a window, or the like so that the combustion zone 40 can be observed. The door 32 is hingeably mounted along one side edge and is positioned above a lower tray 34. The tray 34 can be provided with a sufficient lip to retain combustion residues such as ash, where the stove is intended as a wood burning stove. Suitably sealing flanges 33 are provided around the edge of the door 32 to provide a tight seal.

A controlled air inlet 35 is provided above the door 32, the control of the air inlet 35 is provided by a regulator in the form of a sliding baffle plate 36 (see FIG. 3) with an aperture in the front 13 of the casing 10 making up the air inlet 35. With reference to FIG. 1, a deflector 37 is provided within the casing in association with the air inlet 35, this deflector 37 takes the form of a plate or vane depending downwardly within the casing and having an outlet so arranged as to deflect inlet air downwardly over the inner face of the transparent portion thus in use reducing window temperature and assisting in avoiding soot, smoke and other residues of combustion building up on said window.

In this form of the invention, an interlock is provided between said door 32, said by-pass damper 26 and control arm assembly 27.

In this form of the invention, and with specific reference to FIGS. 3 and 4, an interlock as generally indicated by arrow 60 is provided as a substantially catch-like member 61 associated with the front face 13 of the casing 10 adjacent an opening edge 32A of the door 32. The interlock 60 includes a substantially U-shaped bracket 62 having legs 63 of the bracket 62 engaged with the front face 13 and slots **62*a* provided in each leg 63, to align with each other and substantially slidably mount an elongate finger 64 therein. The finger 64 has a butt end 65 thereof engaged with an outer portion 27*a* of the control arm 27; the butt end 65 is provided with a loose fit aperture therein, through which the outer portion 27*a* of the control arm 27** engages.

With particular reference to FIG. 4, the outer end **27*a* of the control arm 27 is provided with a cam portion 66 thereon being provided as the outer end portion 27 angled out of alignment with remaining portions of the control arm 27 so as to provide substantially ramped surfaces 67 which, upon longitudinal movement of the control arm 27 in directions of arrows 68, impinge on adjacent portions of the loose fit aperture. In this form of the invention, the outer end portion 27*a* of the control arm 27 is angled downwardly to provide the cam portion 66 and then outwardly toward the handle 31**.

A distal end portion 69 of the finger 64 engages within a stop member 70 formed on an inner face of the door 32 so that when in an engaged position as shown in FIGS. 3 and 4 the distal end 69 engages behind an upstanding part 71 of the recess 70 to hold the door 32 in a closed position, yet upon movement of the control arm 27 by drawing the control arm 27 outwardly of the stove, it will be appreciated that the finger 64 rides up the cam portion 66 and is thus raised to disengage the distal end 69 from the stop member 70 and thus facilitate the opening of the door 32. Movement thus of the control arm 27 also removes the by-pass damper 26 from the by-pass aperture 25.

Returning again to FIGS. 1 and 2, main combustion zone 40 is provided in the lower region of the casing 10 and for purposes of illustration a log 41 is shown together with broken line X to indicate the general flow path of primary air and combustion gases during the main combustion mode. The path of secondary air entering through the inlet 35 is shown by broken line Y.

The stove may be surrounded by a heat exchanger housing, through which, air may be drawn by convection to provide a further heating effect so that air moving around the sides 12, 14 of the stove will be heated, and can then pass out of the housing to heat the room. Such a housing 44 is shown by broken lines to illustrate the type of housing suitable for a stove which may fit within an existing fireplace. The housing 44 being provided with an outlet grill 45, and an inlet 46.

In use, a fire can be started by using kindling around a log or other article to be burned, fully opening the air inlet 35 and moving and by-pass damper 26 to open the by-pass aperture 25. Once a fire has started, the by-pass damper 26 and air regulator 36 can be adjusted until the main combustion mode is achieved. This is shown in FIG. 1 where the by-pass damper 26 is fully closed. Primary air enters through controlled inlet 35 and is deflected downwardly over the transparent portion of the door 32 and onto the log in the primary combustion zone 40. Combustion gases follow a path approximately that of the broken line X sweeping over the log, around the underside of partition 20 and thence through the baffles 21 and 22 to the outlet 24. The path X is in effect a "rolling smoke action" and can be seen if smoke producing material is introduced into the combustion zone.

After primary combustion at 40, gases re-ignite in the secondary combustion zone both adjacent the underside and front of the partition and between the partition 20 and the roof 15. Secondary air from the inlet 35 follows path Y and combines with any unburned combustion gases to enable said secondary combustion.

The controlled amount and direction of air flow X in the main combustion zone means that a log situated within the main combustion zone 40 can be burned slowly (if the air inlet 35 is restricted). In fact, a log can be burned slowly from the door end towards the rear wall in the manner of a cigar, with the ash remaining in place. This rolling smoke action is believed to assist in the production of charcoal and in more efficient combustion of logs and the like.

It will be appreciated that by providing an interior partition 20 as illustrated in conjunction with a movable outlet baffle 26, it is possible to provide a slow combustion stove which is readily started and easily converted to the slow combustion mode. In addition, by providing a partition and a series of baffles between the partition 20 and the roof 15, it is possible to increase the flow path distance and increase turbulence of secondary combustion gases, and thus the heating of the stove as well as continuing the secondary combustion zone. By providing an air inlet above a transparent portion in the door 32 it is possible to use the inlet air to cool the interior face of the door, and also to assist in keeping it free of soot, ash, stains and the like. This upper air inlet also assists in providing the rolling smoke action.

Moreover, this upper air inlet does away with the need for a separate secondary air inlet and allows the primary air which sweeps down over the door to be pre-heated before reaching the combustion zone.

By providing a tray 34, it is possible to collect combustion residues in the bottom of the stove so that the stove does not need to be cleaned daily where wood is burnt. If coal of other fuel is to be used, then a grate should be used.

It is also believed that by providing an uncooled inner ceiling or partition 20, better combustion of the unburned gases is achieved and the possibility of soot formation is reduced.

Although only two sets of baffles are illustrated, it will be noted that other numbers of configurations of baffles could be utilized. It will be appreciated that the stove may be free standing, or mounted in a fireplace, or provided with a heat exchange housing for convection air if required.

Although the stove shown in the drawings is box shaped it will be appreciated that the casing can be any desired shape and need not be of rectangular configuration. Indeed, for styling purposes the exterior of the stove may be formed of a curved or rounded configuration.

Whilst the invention has been described with reference to a preferred embodiment, it will be appreciated that various other alterations or modifications may be used to the foregoing without departing from the scope of this invention, as exemplified by the following claims. The claims also form part of the description.

I claim:

1. In a stove including a casing surrounding a combustion zone, a door in one wall of the casing, an air inlet in an upper region of the casing, a deflector in conjunction with said air inlet to deflect air within said casing past a transparent portion in a front face of said casing and to an outlet from said casing, a partition within said casing adjacent said outlet, said outlet being situated in said upper region of said casing remote from said transparent portion and said partition extends from the region of the outlet towards said transparent portion, so that in use, combustion air is drawn down inside the casing from the air inlet toward a primary combustion zone, past at least a portion of the transparent portion and then along the underside of the partition before passing by the partition into a secondary combustion zone and to the outlet, and a by-pass aperture in said partition and adjacent said outlet and closeable by a movable by-pass damper, the improvement comprising said damper is adapted to substantially float relative to said aperture so that it can be lifted away from and into and out of closing relationship with said by-pass aperture, and means to bias said damper toward said aperture, a movable control rod conncted to said damper to remotely operate said damper, the connection between the damper and the control rod comprising the damper being mounted upon the control rod with a tolerance for limited floating movement of the by-pass damper relative to the control rod, and an interlocking means to lock said door in a closed position when said by-pass aperture is closed by said damper comprising a movable finger mounted on said casing, and a cam portion on said control rod operatively engaging said finger so that said finger is movable by said cam portion into and out of interlocking engagement with a portion of the door.

2. A stove as claimed in claim 1 and further comprising a locking finger mounting bracket on said casing, said locking finger being slidably mounted on said bracket so that one end is removably engageable with said door locking member and the other end slidably engages with said control rod cam portion, said cam portion comprising a part of said control rod between said bracket and said damper extending at an angle with respect to said control rod, so that upon movement of said control rod outwardly of said stove said damper is moved off of said by-pass aperture and said locking finger is moved out of locking engagement with said door locking member, and upon movement of said control rod inwardly of the stove with the door closed the damper moves into closing position with respect to said by-pass aperture and said locking finger engages in locking position with said door locking member.

3. A stove as claimed in claim 2 wherein said air inlet is positioned above said door and wherein said transparent portion is in said door.

4. A stove as claimed in claim 1 wherein the stove includes a heat exchanger for convection of air.

5. A stove as claimed in claim 1 wherein at least one baffle is positioned between said partition and said casing.

6. A stove as claimed in claim 1 wherein at least one baffle is provided with a plurality of spaced apart apertures therein, through which the gases of combustion and unburned gases pass to proceed into said secondary combustion zone.

* * * * *